US007533617B2

(12) United States Patent
Krautzig

(10) Patent No.: US 7,533,617 B2
(45) Date of Patent: May 19, 2009

(54) BOGIE FOR A RAIL VEHICLE

(75) Inventor: Steffen Krautzig, Winterthur (CH)

(73) Assignee: Bombardier Transportation GmbH, Berlin (DE)

( * ) Notice: Subject to any disclaimer, the term of this patent is extended or adjusted under 35 U.S.C. 154(b) by 99 days.

(21) Appl. No.: 11/525,109

(22) Filed: Sep. 21, 2006

(65) Prior Publication Data

US 2007/0079725 A1 Apr. 12, 2007

(30) Foreign Application Priority Data

Sep. 22, 2005 (GB) ..... 0519353.7

(51) Int. Cl.
*B61F 5/26* (2006.01)
*B61F 3/00* (2006.01)

(52) U.S. Cl. ..... 105/218.1; 105/197.05; 105/182.1

(58) Field of Classification Search ..... 105/218.1–226
See application file for complete search history.

(56) References Cited

U.S. PATENT DOCUMENTS 3,808,693 A * 5/1974 Plasser et al. ..... 33/523.2
3,855,940 A * 12/1974 Pinto ..... 105/77
3,884,157 A * 5/1975 Pelabon ..... 105/199.3
3,945,325 A * 3/1976 Zehnder ..... 105/167
4,173,933 A * 11/1979 Kayserling ..... 105/182.1
4,185,854 A * 1/1980 Brando ..... 280/677
4,461,217 A * 7/1984 Girod et al. ..... 105/135
4,491,074 A * 1/1985 Ackermann et al. ..... 105/164
4,658,734 A * 4/1987 Mroz ..... 105/169
5,083,513 A * 1/1992 Kobayashi ..... 105/168
5,090,333 A * 2/1992 Bieker et al. ..... 105/218.1
5,235,918 A * 8/1993 Durand et al. ..... 105/222
5,666,885 A * 9/1997 Wike ..... 105/168
5,909,711 A * 6/1999 Vogel et al. ..... 105/168
7,066,095 B2 * 6/2006 Augsburg et al. ..... 105/157.1
2007/0079725 A1 * 4/2007 Krautzig ..... 105/197.05
2007/0193471 A1 * 8/2007 Searancke ..... 104/291

FOREIGN PATENT DOCUMENTS

AT 328 501 B 3/1976
DE 883 292 C 7/1953
GB 1 033 587 A 6/1966

* cited by examiner

*Primary Examiner*—S. Joseph Morano
*Assistant Examiner*—Jason C Smith
(74) *Attorney, Agent, or Firm*—The Webb Law Firm

(57) ABSTRACT

Bogie for a rail vehicle including a first and second wheel unit, each unit having two wheels, and a bogie frame supported on the first and second wheel units via a primary spring unit per wheel. A first primary spring unit being associated with a first wheel of the first wheel unit and a second primary spring unit being associated with a second wheel of the second wheel unit. The first and second wheels being located on the same side of the bogie frame. The first wheel unit and the second wheel unit being connected via a compensation device mounted to the bogie frame. The compensation device being connected to the first and second wheel unit via a first interface and second interface of the first and second primary spring unit, respectively wherein a shift of the first interface causes a shift of the second interface.

18 Claims, 3 Drawing Sheets

BOGIE FOR A RAIL VEHICLE

The present invention relates to a bogie for a rail vehicle having a longitudinal bogie axis and comprising a first wheel unit comprising two wheels, a second wheel unit comprising two wheels and a bogie frame, the first wheel unit being spaced from the second wheel unit along the longitudinal bogie axis. The bogie frame is supported on the first wheel unit and the second wheel unit via a primary spring unit per wheel, a first primary spring unit being associated to a first wheel of the first wheel unit and a second primary spring unit being associated to a second wheel of the second wheel unit, the first wheel and the second wheel being located on the same side of the bogie frame. The first wheel unit and the second wheel unit are connected via a compensation device mounted to the bogie frame.

One of the main requirements set for a running gear of a rail vehicle is derailment safety, i.e. the safety against the loss of contact between one or several wheels of the running gear and the respective rail, e.g. due to deformations within the track. The main problem in this context is that running gears typically used in rail vehicles comprise at least four wheels and, thus, four wheel contact points with the rails of the track. Thus, with a geometry of the track leading to a deviation of the four wheel contact points from a planar arrangement, given a certain rigidity of the running gear assembly, the risk increases that one of the wheels lifts off the track. Such a wheel lift-off situation has to be avoided under any circumstances.

Typical criteria for the evaluation of derailment safety of a bogie are the ratio of the wheel contact force to the transverse wheel force and the remaining wheel contact force. These criteria are tested in different test setups depending on the standardization system the operator of the rail vehicle applies. According to the UIC (Union Internationale des Chemins de Fer) system a standardized twisted track is generally used while in the AAR (American Association of Railroads) a so called vertical dip test with a vertical dip in the outer rail of a curved track is used. Independent of the test setup, the operator of the rail vehicle may define individual limits to be respected by the test results in order to prove acceptable derailment safety.

Several approaches have been taken to guarantee derailment safety of typical rail vehicles comprising a car body supported on two running gears spaced apart from each other. All of them aim to keep the contact forces at all wheel contact points as even as possible.

Some approaches base on a reduction of the rigidity against longitudinal torsion of the bogie frame supported on the wheels. It has been suggested either to reduce the rigidity of the single part bogie frame or to execute the bogie frame as a two part device, its parts being movably linked together. The first approach has considerable disadvantages in terms of its useful life since excessive deformation, in particular upon introduction of traction or braking forces, as well as damage of the bogie frame and parts connected thereto due to such excessive deformation may easily occur. The second approach has considerable disadvantages in terms of its stable running characteristics. This is due to the fact that play and ageing within the linkage of both frame parts may adversely affect the running characteristics of the bogie. Furthermore, the linkage poses considerable problems with respect to the introduction of traction or braking forces into the bogie.

Further approaches base on a reduction of the rigidity of the primary spring system. However, these approaches show considerable disadvantages in terms of deteriorated pitching and rolling behavior of the vehicle. Furthermore, large relative movements have to be provided and taken by the components, in particular the traction components, such as flexible couplings, connected to the wheels and arranged in parallel to the primary spring system.

A third approach bases on a load compensation mechanism between the wheels on both sides of the bogie. In a generic bogie as outlined above, which is also called goose neck bogie, on both sides of the bogie, a compensation beam (having a goose neck shape at both ends) rigidly connects the wheel bearings of the two wheels aligned in the direction of travel. Between the axles of the wheels the primary springs carrying the bogie frame are supported on the compensation beam. This arrangement—to some extent—provides equalization between the wheel contact forces of the wheels on the respective side of the bogie. However, due to the reduced longitudinal distance between the primary springs, the pitching behavior of the vehicle is deteriorated. Furthermore, the compensation beam represents a non-sprung mass that is subjected to considerable dynamic loads. Thus, it has to be a relatively bulky and expensive part of considerable mass. This, in turn, leads to a considerable increase in the non-sprung mass of the bogie having adverse effects on the dynamic behavior of the bogie.

It is thus an object of the present invention to provide a bogie that, at least to some extent, overcomes the above disadvantages. It is a further object of the present invention to provide a bogie that provides enhanced derailment safety and good dynamic behavior.

The present invention is based on the technical teaching that enhanced derailment safety and good dynamic behavior of the bogie may be achieved by providing in a generic bogie wherein the compensation device is located such that it forms part of the sprung mass of the bogie. This has the beneficial effect that, while providing the desired equalization between the wheel contact forces leading to enhanced derailment safety, the compensation device is subjected to reduced dynamic loads and, thus, may be of lighter, less complicated and less bulky design. Thus, compared to the known goose neck bogie, the overall mass, in particular the non-sprung mass, of the bogie is considerably reduced leading to improved dynamic behavior of the bogie.

Thus, according to the invention, the compensation device is connected to the first wheel unit via a first interface of the first primary spring unit and to the second wheel unit via a second interface of the second primary spring unit. Furthermore, the compensation device is arranged such that a shift of the first interface causes a shift of the second interface. By connecting the compensation device to the first wheel unit via a first interface of the first primary spring unit and to the second wheel unit via a second interface of the second primary spring unit it achieved that the compensation device forms part of the sprung mass of the bogie. The coupled shift in the interfaces of the primary spring units with the compensation device provides the desired equalization between the wheel contact forces of the first and second wheel unit with its beneficial effect on derailment safety.

It will be appreciated that the compensation device may be provided on both sides of the bogie. However, preferably, only one single compensation device per bogie is provided on one of the sides of the bogie. Thus, a less complicated and less expensive design may be achieved providing good derailment safety and good dynamic behavior.

It will be further appreciated that the compensation device may be designed such that only parts of it are movable with respect to the bogie frame. For example, the coupled shift in the interfaces of the primary spring units with the compensation device may be provided via the movable parts of communicating actuators, e.g. hydraulic actuators. With variants of the invention, which are preferred due to their simple design, the entire compensation device is movably mounted to the bogie frame. Thus, simple mechanical solutions that eventually even require only one single movable part may be realized.

The compensation device may be designed in any suitable way. With preferred embodiments, the compensation device comprises a compensation lever, the compensation lever being tiltably mounted to the bogie frame. Thus, a very simple purely mechanical solution may be achieved.

With further preferred embodiments, the compensation device comprises a compensation rod, the compensation rod being shiftably mounted to the bogie frame. Here as well, a very simple purely mechanical solution may be achieved. In particular, the compensation rod may be arranged such that it is subjected to a favorable load distribution. For example, the compensation rod may be arranged such that it undergoes a mainly axially directed compressive load. Under these circumstances, the compensation rod may be a relatively small and lightweight component.

Such a configuration may be easily achieved in a design where the primary spring units are arranged to have lying longitudinal axes as it is known, for example, from bogies of the so called München-Kassel type. Preferably, the first primary spring unit has a first longitudinal spring unit axis, the second primary spring unit has a second longitudinal spring unit axis and the compensation rod has a third longitudinal axis, the first longitudinal spring unit axis, the second longitudinal spring unit axis and the third longitudinal axis being substantially parallel.

With preferred embodiments of the invention, modifying the bogies of the München-Kassel type, a wheel bearing unit is provided for each of the wheels, the wheel bearing unit being tiltably mounted to the bogie frame and being further connected to the bogie frame via the associated one of the primary spring units. Preferably, the wheel bearing unit is formed in the manner of an angular lever having a first end, a second end and an articulation point located between the first end and the second end. The wheel bearing unit is tiltably mounted to the bogie frame at the articulation point and is contacting the associated one of the wheel units at the first end and the associated one of the primary spring units at the second end. Furthermore, preferably, each one of the primary spring units has a longitudinal spring unit axis, the longitudinal spring unit axis being substantially parallel to the longitudinal bogie frame axis.

A separate guiding device may be provided for the movable parts of the compensation device. However, other functional components of the bogie may, at least in part, integrate the function of such a guide device. With further preferred embodiments of the invention, the compensation device comprises at least one movable part, the movable part being movable with respect to the bogie frame and being guided during operation of the compensation device by at least one of the first primary spring unit and the second primary spring unit.

With preferred embodiments of the invention, the compensation device has a neutral state and a resetting device is provided, the resetting device resetting the compensation device to the neutral state. Such a resetting device may be a component of the compensation device or formed by at least one of the first primary spring unit and the second primary spring unit. The neutral state may be the position usually taken by the compensation device when the vehicle stands on a straight horizontal track.

With further preferred embodiments of the invention, the compensation device has a neutral state and a deflection resistance device is provided, the deflection resistance device defining a deflection resistance profile of a resistance of the compensation device against deflection from the neutral state. Thus, by selecting the deflection resistance profile, the dynamic properties of the bogie may easily adjusted to the specific needs. In particular, with this, it is easily possible to adapt the dynamic properties to different country or operator specific requirements for such a rail vehicle. Depending on the dynamic requirements, the deflection resistance profile may be a linear or a progressively mounting profile. Preferably, the deflection resistance profile is adjustable. Thus, it may be easily reacted to modified requirements, even at a later date after manufacture.

With further preferred embodiments of the invention, the deflection of the compensation device may be limited in order to limit the stroke and compensation effect to reasonable amounts. This limitation may be achieved by any suitable means. Preferably, the compensation device has a neutral state and at least one stop device is provided, the stop device limiting deflection of the compensation device from the neutral state.

With further preferred embodiments of the invention, the operation of the compensation device may be damped to provide beneficial vibration characteristics, in particular, to enhance riding comfort. Thus, preferably, the compensation device has a neutral state and at least one damping device is provided, the damping device damping deflection of the compensation device from the neutral state.

The invention may be applied in the of any suspension concept with internal or external wheel bearings of the wheel sets. Preferably external wheel bearings are provided since, in this case, sufficient space is available internally to the bogie to receive traction equipment etc. Thus, preferably, a wheel bearing unit is provided for each of the wheels, the wheel bearing unit being arranged externally to the space formed between the wheels of the associated one of the wheel units.

As mentioned above, any suitable concept for providing the coupled shift of the interfaces of the primary spring units may be selected. As mentioned, apart from purely mechanical solutions, coupled actuators using other than purely mechanical actuation principles may be used. Thus, for example hydraulic, pneumatic, electro-mechanical and other principles may be used as well as arbitrary combinations thereof. With preferred embodiments of the invention, the compensation device comprises at least one coupling device, the coupling device coupling the first interface and the second interface using a working fluid, e.g. a gas or a hydraulic fluid.

The present invention also relates to a rail vehicle comprising a bogie according to the present invention. With such a vehicle, the embodiments and advantages of the present invention as they have been described in the foregoing may be achieved to the same extent. Thus, it is here simply referred to the above.

Further embodiments of the present invention will become apparent from the dependent claims and the following description of preferred embodiments which refers to the appended figures.

FIRST EMBODIMENT

Figure 1:
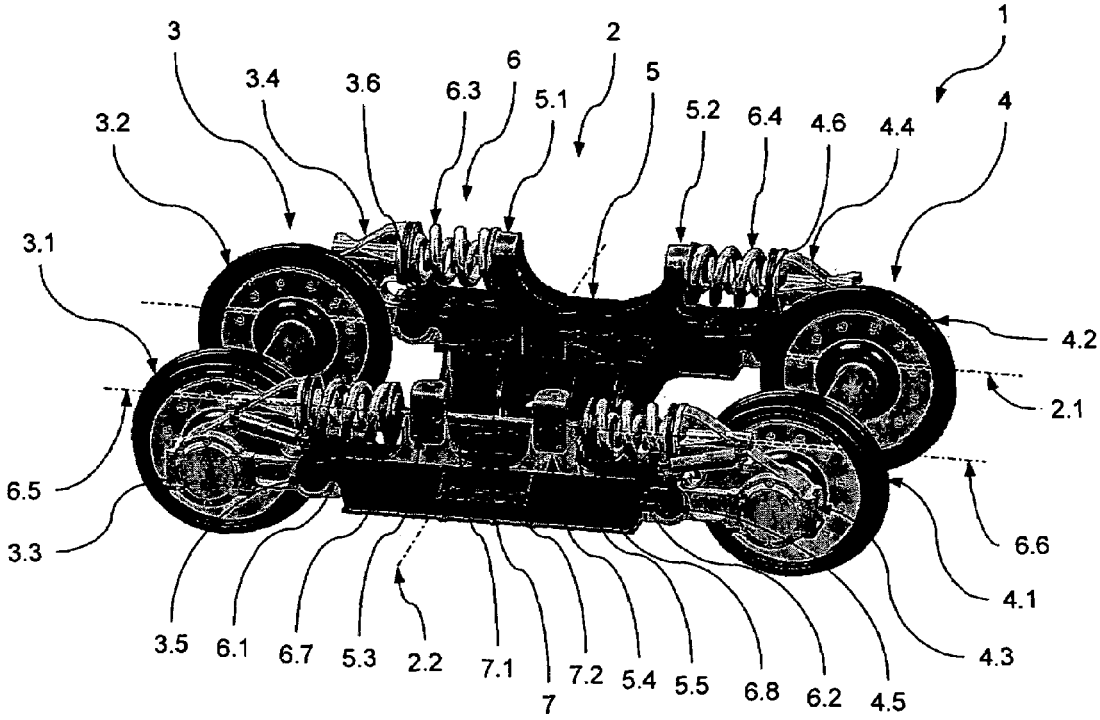
FIG. 1 is a schematic perspective view of a part of a preferred embodiment of the vehicle according to the present invention comprising a preferred embodiment of the bogie according to the present invention.

With reference to FIG. 1 a first preferred embodiment of a rail vehicle 1 according to the invention with a bogie 2 according to the invention will now be described in greater detail. FIG. 1 is a schematic perspective view of a part of the rail vehicle 1 which comprises a bogie 2 supporting a car body (not shown) of the vehicle 1.

The bogie 2 comprises a first wheel unit in the form of a first wheel set 3 and a second wheel unit in the form of a second wheel set 4. The bogie 2 further comprises a substantially H-shaped bogie frame 5 that is supported on the first wheel set and the second wheel set 4 via a primary spring system 6. The bogie frame 5, in a conventional manner, supports the car body (not shown) via a secondary spring system (not shown).

The first wheel set 3 and the second wheel set 4 are spaced apart along the longitudinal axis 2.1 of the bogie 2. Thus, along the longitudinal axis 2.1 of the bogie 2, a first wheel 3.1 of the first wheel set 3 is aligned with a second wheel 4.1 of the second wheel set 4, while a third wheel 3.2 of the first wheel set 3 is aligned with a fourth wheel 4.2 of the second wheel set 4.

Each wheel set 3, 4 is connected to the bogie 2 via two wheel set bearings units 3.3, 3.4 and 4.3, 4.4, respectively. Each wheel set bearing unit 3.3, 3.4, 4.3 and 4.4, respectively, is formed in the manner of an angular lever having a first end, a second end and an articulation point 3.5, 3.6, 4.5 and 4.6, respectively, located between the first end and the second end.

At the respective articulation point 3.5, 3.6, 4.5 and 4.6 the respective wheel set bearing unit 3.3, 3.4, 4.3 and 4.4 is mounted to the bogie frame 5 such that is tiltable about a tilt axis that is substantially parallel to the transverse axis 2.2 of the bogie 2.

At the first end, the respective wheel set bearing unit 3.3, 3.4, 4.3, 4.4 is contacting the associated wheel set 3 and 4, respectively. At the second end, the respective wheel set bearing unit 3.3, 3.4, 4.3, 4.4 is contacting a primary spring unit 6.1, 6.2, 6.3 and 6.4, respectively, of the primary spring system 6. A first primary spring unit 6.1 contacts the first wheel bearing unit 3.3 which, in turn, is associated to the first wheel 3.1. A second primary spring unit 6.2 contacts the second wheel bearing unit 4.3 which, in turn, is associated to the second wheel 4.1. A third primary spring unit 6.3 contacts the third wheel bearing unit 3.4 which, in turn, is associated to the third wheel 3.2. Finally, a fourth primary spring unit 6.4 contacts the fourth wheel bearing unit 4.4 which, in turn, is associated to the fourth wheel 4.2.

The primary spring units 6.1, 6.2, 6.3 and 6.4 are arranged in a lying configuration as it is known, for example, form the so called München-Kassel bogies. Here, the longitudinal axes of primary spring units 6.1, 6.2 and 6.3, 6.4 that are aligned along the longitudinal axis 2.1 of the bogie 2 substantially coincide at least under a nominal static load situation. Thus, in other words, the first longitudinal spring unit axis 6.5 of the first primary spring unit 6.1 and the second longitudinal spring unit axis 6.6 of the second primary spring unit 6.2 substantially coincide at least under such a nominal static load situation.

On one longitudinal side of the bogie 2, the third primary spring unit 6.3 and the fourth primary spring unit 6.4, at their other end facing away from the associated wheel bearing unit 3.4 and 4.4, respectively, contact a rigid console 5.1 and 5.2, respectively, rigidly mounted to the bogie frame 5.

On the contrary and according to the invention, on the other longitudinal side of the bogie 2, the first primary spring unit 6.1, at its other end facing away from the first wheel bearing unit 3.3, has a first interface 6.7 where it contacts a compensation device 7. Similarly, the second primary spring unit 6.2, at its other end facing away from the second wheel bearing unit 4.3, has a second interface 6.8 where it contacts the compensation device 7.

The compensation device 7 comprises a simple compensation rod 7.1 mounted to the bogie frame 5. The compensation rod 7.1 has a longitudinal axis 7.2 that is parallel to the longitudinal axis 2.1 of the bogie. The compensation rod 7.1 has plate-like ends contacting the first interface 6.7 of the first primary spring unit 6.1 and the second interface 6.8 of the second primary spring unit 6.2, respectively.

However, it will be appreciated that, with other embodiments of the invention, the ends of the compensation rod may have any other suitable shape. For example, they may show no substantially increased diameter but a simple articulation or the like connecting the compensation rod to a suitable structure of the primary spring unit forming the respective first and second interface.

The compensation rod 7.1 is mounted to the bogie frame 5 via two support elements 5.3 and 5.4. The support elements 5.3 and 5.4 guide the compensation rod 7.1 such that it may be shifted along its longitudinal axis 7.2, i.e. deflected from its neutral state shown in FIG. 1. Furthermore, the support elements 5.3 and 5.4 are arrange such that the longitudinal axis 7.2 of the compensation rod 7.1 substantially coincides with the first longitudinal spring unit axis 6.5 of the first primary spring unit 6.1 and the second longitudinal spring unit axis 6.6 of the second primary spring unit 6.2.

With this very simple arrangement, according to the invention, it is achieved that a shift in the first interface 6.7 causes a corresponding shift in the second interface 6.8. Thus, the compensation device 7 provides equalization between the wheel contact forces of the first wheel 3.1 and the second wheel 4.1 under a broad range of load situations leading to enhanced derailment safety. To some extent, the first wheel 3.1 and the second wheel 4.1 may thus follow deformations within the track without loosing contact with the rail and without substantial differences within the wheel contact force. Thus, to some extent, the suspension of the first wheel 3.1 and the second wheel 4.1 behaves similar to a configuration where only a single wheel is mounted to this longitudinal side of the bogie 2. In other words, with the two conventionally mounted wheels 3.2 and 4.2 on the other longitudinal side of the bogie 2, a support configuration with a behavior similar to a three point support may be achieved.

In order to limit the equalization between the wheel contact forces of the first wheel 3.1 and the second wheel 4.1 to reasonable load situations, longitudinal stop elements 5.5 are provided at the bogie frame 5. The respective longitudinal stop element 5.5 is arranged to cooperate with the respective plate-like end of the compensation rod 7.1 in order to limit maximum deflection of the compensation rod 7.1 from its neutral state.

It will be appreciated that the primary spring system 6, when realizing the invention, does not have to undergo any changes. Thus, the adjustment of the primary spring system 6 may correspond to the adjustment of a conventional primary spring system. Furthermore, when contrary forces of equal amount are exerted onto the compensation device 7 via the first interface 6.7 and the second interface 6.8, as it is the case in a pure rolling motion of the car body, these forces balance each other such that there is no shift in the compensation device 7 and, thus, in the first interface 6.7 and the second interface 6.8. Thus, the rolling behavior of the vehicle 1 corresponds to the rolling behavior of a conventional vehicle.

Since the compensation device 7 forms part of the sprung mass of the bogie 2, the compensation device 7 is subjected to reduced dynamic loads and, thus, may be relatively light, simple and of small size. Thus, compared to the known goose neck bogie mentioned initially, the overall mass, in particular the non-sprung mass, of the bogie 2 is considerably reduced leading to improved dynamic behavior of the bogie 2 compared to known goose neck bogies.

The first primary spring unit 6.1 and the second primary spring unit 6.2 form a resetting device resetting the compensation rod 7.1, i.e. the compensation device 7, back to its neutral position under a corresponding load situation. However, it will be appreciated that, with other embodiments of the invention, a separate resetting device may be provided. For example, a separate spring device or the like may be mounted between the bogie frame and the compensation rod. Furthermore, via such a resetting device, the profile of a resistance against deflection of the compensation rod may be adjustable. Finally, one or more dampers may be mounted between the bogie frame and the compensation rod to dampen the deflection of the compensation rod. Thus, the behavior of the compensation device 7 may be easily adjusted to any operational requirements.

The wheel set bearing units 3.3, 3.4, 4.3 and 4.4, respectively, are located outside the space formed between the wheels of the associated wheel set 3 and 4, respectively. This external support has the advantage that sufficient space is available between the wheels for traction and braking equipment etc.

As is apparent from the above description, the configuration with lying primary spring units has considerable advantages in terms of simple design of the compensation device. However, it will be appreciated that the invention may not only be used with primary spring systems with lying primary spring units. As will be explained in the following, the invention may also be used with primary spring systems having primary spring units of an arbitrary orientation.

SECOND EMBODIMENT

Figure 2:
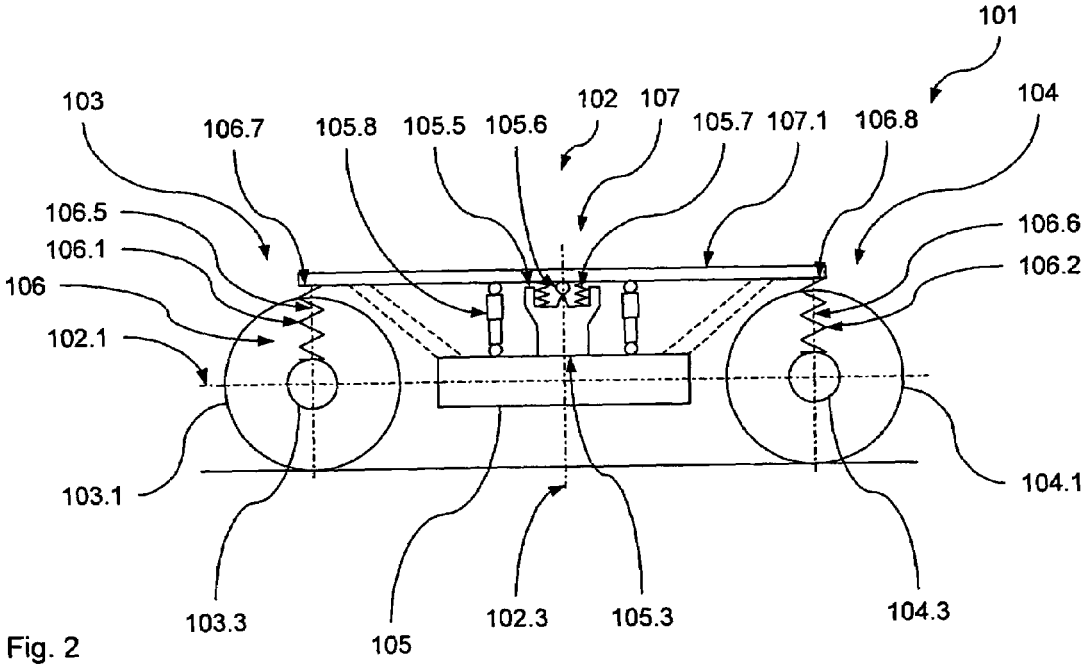
FIG. 2 is a schematic side view of a part of a further preferred embodiment of the vehicle according to the present invention comprising a preferred embodiment of the bogie according to the present invention.
Figure 3:
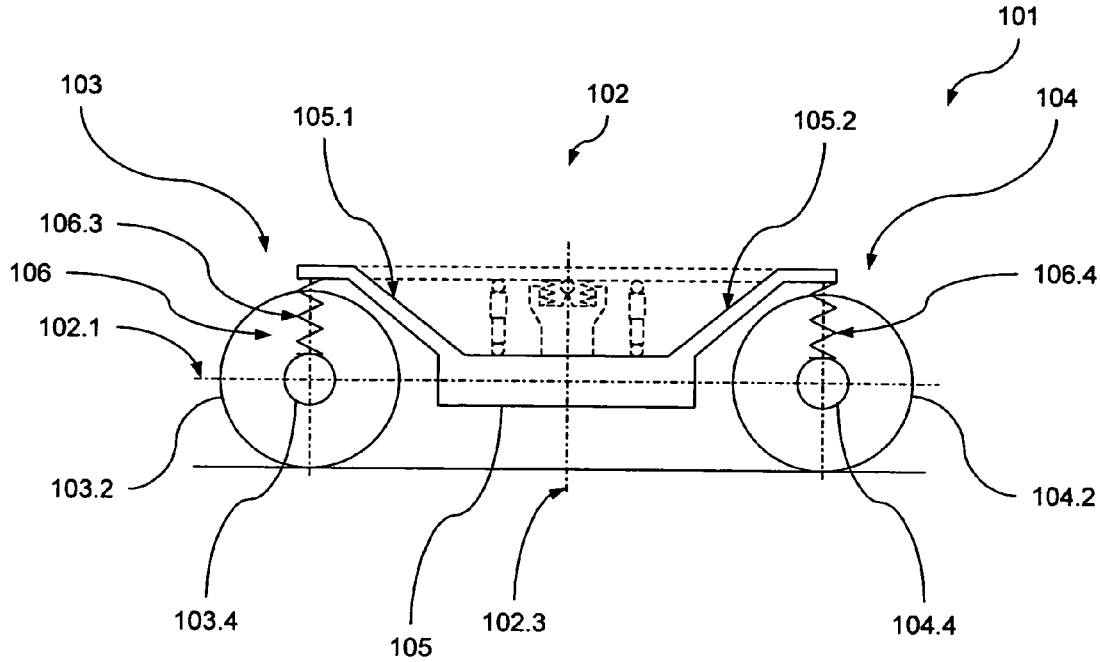
FIG. 3 is a schematic view of the other side of the vehicle of FIG. 2.

In the following, a second preferred embodiment of a rail vehicle 101 according to the invention with a bogie 102 according to the invention will be described in greater detail with reference to FIGS. 2 and 3. FIG. 2 is a schematic view of a part of one longitudinal side of the rail vehicle 101 which comprises a bogie 102 supporting a car body (not shown) of the vehicle 101. FIG. 3 is a schematic view of the other longitudinal side of the rail vehicle 101.

It should be noted that, in FIGS. 2 and 3, parts located on the respective other longitudinal side of the rail vehicle 101 and typically obscured, in the respective view, by parts located within the central area of the bogie 102, for reasons of clarity, are only indicated by broken lines.

The bogie 102 comprises a first wheel unit in the form of a first wheel set 103 and a second wheel unit in the form of a second wheel set 104. The bogie 102 further comprises a bogie frame 105 that is supported on the first wheel set and the second wheel set 104 via a primary spring system 106. The bogie frame 105, in a conventional manner, supports the car body (not shown) via a secondary spring system (not shown).

The first wheel set 103 and the second wheel set 104 are spaced apart along the longitudinal axis 102.1 of the bogie 102. Thus, along the longitudinal axis 102.1 of the bogie 102, a first wheel 103.1 of the first wheel set 103 is aligned with a second wheel 104.1 of the second wheel set 104, while a third wheel 103.2 of the first wheel set 103 is aligned with a fourth wheel 104.2 of the second wheel set 104.

Each wheel set 103, 104 is connected to the bogie 102 via two wheel set bearings units 103.3, 103.4 and 104.3, 104.4, respectively. The respective wheel set bearing unit 103.3, 103.4, 104.3, 104.4 is contacting the associated wheel set 103 and 104, respectively. Furthermore, the respective wheel set bearing unit 103.3, 103.4, 104.3, 104.4 is contacting a primary spring unit 106.1, 106.2, 106.3 and 106.4, respectively, of the primary spring system 106.

A first primary spring unit 106.1 contacts the first wheel bearing unit 103.3 which, in turn, is associated to the first wheel 103.1. A second primary spring unit 106.2 contacts the second wheel bearing unit 104.3 which, in turn, is associated to the second wheel 104.1. A third primary spring unit 106.3 contacts the third wheel bearing unit 103.4 which, in turn, is associated to the third wheel 103.2. Finally, a fourth primary spring unit 106.4 contacts the fourth wheel bearing unit 104.4 which, in turn, is associated to the fourth wheel 104.2.

The primary spring units 106.1, 106.2, 106.3 and 106.4 are arranged in a conventional standing configuration. Thus, the longitudinal axes of primary spring units 106.1, 106.2 and 106.3, 106.4 are substantially parallel to the height axis 102.3 of the bogie 102 at least under a nominal static load situation.

On the one longitudinal side of the bogie 102 shown in FIG. 3, the third primary spring unit 106.3 and the fourth primary spring unit 106.4, at their end facing away from the associated wheel bearing unit 103.4 and 104.4, respectively, contact a beam 105.1 and 105.2, respectively, rigidly mounted to the bogie frame 105.

On the contrary and according to the invention, on the other longitudinal side of the bogie 102 shown in FIG. 2, the first primary spring unit 106.1, at its end facing away from the first wheel bearing unit 103.3, has a first interface 106.7 where it contacts a compensation device 107. Similarly, the second primary spring unit 106.2, at its end facing away from the second wheel bearing unit 104.3, has a second interface 106.8 where it contacts the compensation device 107.

The compensation device 107 comprises a simple compensation lever 107.1 mounted to the bogie frame 105. The compensation lever 107.1 has free ends, one contacting the first interface 106.7 of the first primary spring unit 106.1 and one contacting the second interface 106.8 of the second primary spring unit 106.2, respectively. Thus, the compensation device 107 together with the bogie frame 105, in a top view, forms a substantially H-shaped structure supported on the wheel sets 103 and 104 and, in turn, supporting the car body (not shown) of the vehicle 101.

The compensation lever 107.1 is pivotably mounted to the bogie frame 105 via a support element 105.3 of the bogie frame 105. The compensation lever 107.1 is mounted such that it may be pivoted, i.e. deflected from its neutral state shown in FIG. 2, about a pivot 105.6 with a pivot axis parallel to the transverse axis of the bogie 102, i.e. perpendicular to the plane of FIG. 2.

With this very simple arrangement, according to the invention, it is achieved that a shift in the first interface 106.7 causes a corresponding shift in the second interface 106.8. Thus, the compensation device 107 provides equalization between the wheel contact forces of the first wheel 103.1 and the second wheel 104.1 under a broad range of load situations leading to enhanced derailment safety. To some extent, the first wheel 103.1 and the second wheel 104.1 may thus follow deformations within the track without loosing contact with the rail and without substantial differences within the wheel contact force. Thus, to some extent, the suspension of the first wheel 103.1 and the second wheel 104.1 behaves similar to a configuration where only a single wheel is mounted to this longitudinal side of the bogie 102. In other words, with the two conventionally mounted wheels 103.2 and 104.2 on the other longitudinal side of the bogie 102, a support configuration with a behavior similar to a three point support may be achieved.

It will be appreciated that the primary spring system 106, when realizing the invention, does not have to undergo any changes. Thus, the adjustment of the primary spring system 106 may correspond to the adjustment of a conventional primary spring system. Furthermore, when contrary forces of equal amount are exerted onto the compensation device 107 via the first interface 106.7 and the second interface 106.8, as it is the case in a pure rolling motion of the car body, these forces balance each other such that there is no shift in the compensation device 107 and, thus, in the first interface 106.7 and the second interface 106.8. Thus, the rolling behavior of the vehicle 101 corresponds to the rolling behavior of a conventional vehicle.

In order to limit the equalization between the wheel contact forces of the first wheel 103.1 and the second wheel 104.1 to reasonable load situations, stop elements 105.5 are provided at the bogie frame 105. The respective stop element 105.5 is arranged to cooperate with the compensation lever 107.1 in order to limit maximum deflection of the compensation lever 107.1 from its neutral state.

Since, here as well, the compensation device 107 forms part of the sprung mass of the bogie 102, the compensation device 107 is subjected to reduced dynamic loads and, thus, may be relatively light, simple and of small size. Thus, compared to the known goose neck bogie mentioned initially, the overall mass, in particular the non-sprung mass, of the bogie 102 is considerably reduced leading to improved dynamic behavior of the bogie 102 compared to known goose neck bogies.

The first primary spring unit 106.1 and the second primary spring unit 106.2 form part of a resetting device resetting the compensation lever 107.1, i.e. the compensation device 107, back to its neutral position under a corresponding load situation. The resetting device further comprises resetting springs 105.7 also acting onto the compensation lever 107.1 in a similar manner. The resetting springs 105.7 have an adjustable spring characteristic and serve to adjust the profile of a resistance against deflection of the compensation lever 107.1. Furthermore, two dampers 105.8 are mounted between the bogie frame 105 and the compensation lever 107.1 to dampen the deflection of the compensation lever 107.1.

The wheel set bearing units 103.3, 103.4, 104.3 and 104.4, respectively, are located outside the space formed between the wheels of the associated wheel set 103 and 104, respectively. This external support has the advantage that sufficient space is available between the wheels for traction and braking equipment etc.

THIRD EMBODIMENT

Figure 4:
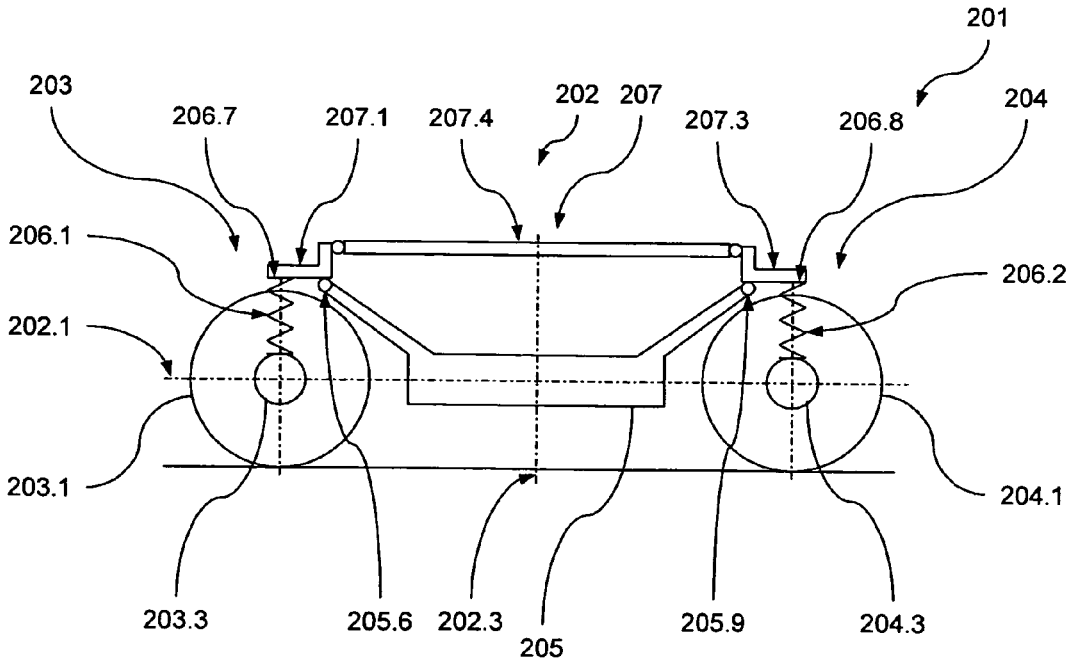
FIG. 4 is a schematic side view of a part of a further preferred embodiment of the vehicle according to the present invention comprising a preferred embodiment of the bogie according to the present invention.

In the following, a third preferred embodiment of a rail vehicle 201 according to the invention with a bogie 202 according to the invention will be described in greater detail with reference to FIG. 4. FIG. 4 is a schematic view of a part of one longitudinal side of the rail vehicle 201 which comprises a bogie 202 supporting a car body (not shown) of the vehicle 201. At its other longitudinal side, the design of the rail vehicle 201 is identical to the design shown in FIG. 3.

The embodiment of FIG. 4, in its principal design and functionality, largely corresponds to the embodiment of FIG. 3. Thus, it will here mainly be referred to the differences only. In particular, the only difference lies within the design of the compensation device 207.

According to the invention, on the longitudinal side of the bogie 202 shown in FIG. 4, the first primary spring unit 206.1, at its end facing away from the first wheel bearing unit 203.3 of the first wheel set 203, has a first interface 206.7 where it contacts the compensation device 207. Similarly, the second primary spring unit 206.2, at its end facing away from the second wheel bearing unit 204.3, has a second interface 206.8 where it contacts the compensation device 207.

The compensation device 207 comprises an angular first compensation lever 207.1 and an angular second compensation lever 207.3, both mounted to the bogie frame 205. A simple compensation rod 207.4 is pivotably mounted to, both, the first compensation lever 207.1 and the second compensation lever 207.3.

The first compensation lever 207.1 has two free ends, one contacting the first interface 206.7 of the first primary spring unit 206.1 and one contacting the compensation rod 207.4.

Similarly, the second compensation lever 207.3 has two free ends, one contacting the second interface 206.8 of the second primary spring unit 206.2 and one contacting the compensation rod 207.4.

The first compensation lever 207.1 is mounted to the bogie frame 205 such that it may be pivoted, i.e. deflected from its neutral state shown in FIG. 4, about a pivot 205.6 with a pivot axis parallel to the transverse axis of the bogie 202, i.e. perpendicular to the plane of FIG. 2.

Similarly, the second compensation lever 207.3 is mounted to the bogie frame 205 such that it may be pivoted, i.e. deflected from its neutral state shown in FIG. 4, about a pivot 205.9 with a pivot axis parallel to the transverse axis of the bogie 202, i.e. perpendicular to the plane of FIG. 2.

The first compensation lever 207.1 and the second compensation lever 207.3 are of identical dimension. Thus, via the push/pull rod formed by the compensation rod 207.4, a synchronized motion is generated between the first compensation lever 207.1 and the second compensation lever 207.3.

With this very simple arrangement, according to the invention, it is achieved that a shift in the first interface 206.7 causes a corresponding shift in the second interface 206.8. Thus, the compensation device 207 provides equalization between the wheel contact forces of the first wheel 203.1 and the second wheel 204.1 under a broad range of load situations leading to enhanced derailment safety. To some extent, the first wheel 203.1 and the second wheel 204.1 may thus follow deformations within the track without loosing contact with the rail and without substantial differences within the wheel contact force. Thus, to some extent, the suspension of the first wheel 203.1 and the second wheel 204.1 behaves similar to a configuration where only a single wheel is mounted to this longitudinal side of the bogie 202. In other words, with the two conventionally mounted wheels 203.2 and 204.2 on the other longitudinal side of the bogie 202, a support configuration with a behavior similar to a three point support may be achieved.

Since, compared to the embodiment of FIG. 2, the components of such compensation device 207 designed as a lever and rod arrangement are subjected to relatively moderate bending moments, they may be of particularly lightweight, simple design and of particularly small size.

In order to limit the equalization between the wheel contact forces of the first wheel 203.1 and the second wheel 204.1 to reasonable load situations, stop elements (not shown) may be provided at the bogie frame 205.

Since, here as well, the compensation device 207 forms part of the sprung mass of the bogie 202, the compensation device 207 is subjected to reduced dynamic loads and, thus, may be relatively light, simple and of small size. Thus, compared to the known goose neck bogie mentioned initially, the overall mass, in particular the non-sprung mass, of the bogie 202 is considerably reduced leading to improved dynamic behavior of the bogie 202 compared to known goose neck bogies.

The first primary spring unit 206.1 and the second primary spring unit 206.2 form a resetting device resetting the compensation lever 207.1, i.e. the compensation device 207, back to its neutral position under a corresponding load situation. The resetting device may further comprises adjustable resetting springs or the like similar to the ones described in the context of FIGS. 2 and 3.

The wheel set bearing units 203.3, 203.4, 204.3 and 204.4, respectively, again are located outside the space formed between the wheels of the associated wheel set 203 and 204, respectively. This external support has the advantage that sufficient space is available between the wheels for traction and braking equipment etc.

FOURTH EMBODIMENT

Figure 5:
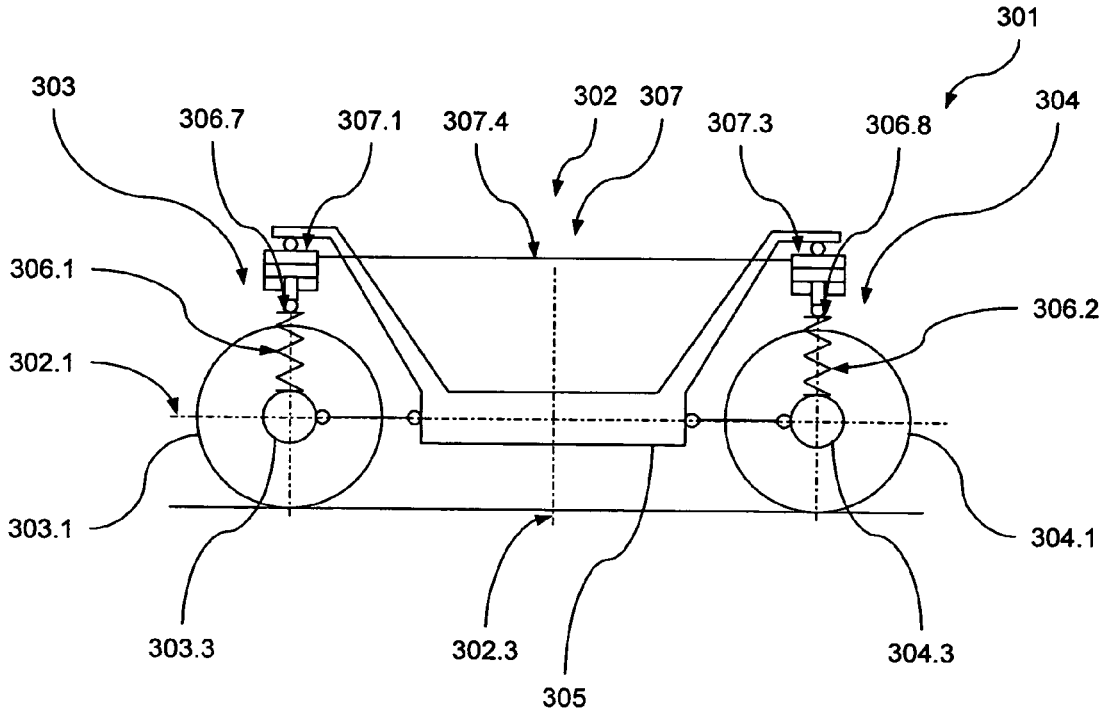
FIG. 5 is a schematic side view of a part of a further preferred embodiment of the vehicle according to the present invention comprising a preferred embodiment of the bogie according to the present invention.

In the following, a fourth preferred embodiment of a rail vehicle 301 according to the invention with a bogie 302 according to the invention will be described in greater detail with reference to FIG. 5. FIG. 5 is a schematic view of a part of one longitudinal side of the rail vehicle 301 which comprises a bogie 302 supporting a car body (not shown) of the vehicle 301. At its other longitudinal side, the design of the rail vehicle 301 is identical to the design shown in FIG. 3.

The embodiment of FIG. 5, in its principal design and functionality, largely corresponds to the embodiment of FIG. 3. Thus, it will here mainly be referred to the differences only. In particular, the only difference lies within the design of the compensation device 307.

According to the invention, on the longitudinal side of the bogie 302 shown in FIG. 5, the first primary spring unit 306.1, at its end facing away from the first wheel bearing unit 303.3 of the first wheel set 303, has a first interface 306.7 where it contacts the compensation device 307. Similarly, the second primary spring unit 306.2, at its end facing away from the second wheel bearing unit 304.3, has a second interface 306.8 where it contacts the compensation device 307.

The compensation device 307 comprises a hydraulic first compensation cylinder 307.1 and a hydraulic second compensation cylinder 307.3, both pivotably mounted to the bogie frame 305. A hydraulic line 307.4 connects the working chambers of the first compensation cylinder 307.1 and the second compensation cylinder 307.3.

The first compensation cylinder 307.1 is articulated to the first interface 306.7 of the first primary spring unit 306.1. Similarly, the second compensation cylinder 307.3 is articulated to the second interface 306.8 of the second primary spring unit 306.2.

The first compensation cylinder 307.1 and the second compensation cylinder 307.3 are of identical dimension. Thus, via the hydraulic line 307.4, a synchronized motion is generated between the first compensation cylinder 307.1 and the second compensation cylinder 307.3.

With this very simple arrangement, according to the invention, it is achieved that a shift in the first interface 306.7 causes a corresponding shift in the second interface 306.8. Thus, the compensation device 307 provides equalization between the wheel contact forces of the first wheel 303.1 and the second wheel 304.1 under a broad range of load situations leading to enhanced derailment safety. To some extent, the first wheel 303.1 and the second wheel 304.1 may thus follow deformations within the track without loosing contact with the rail and without substantial differences within the wheel contact force. Thus, to some extent, the suspension of the first wheel 303.1 and the second wheel 304.1 behaves similar to a configuration where only a single wheel is mounted to this longitudinal side of the bogie 302. In other words, with the two conventionally mounted wheels 303.2 and 304.2 on the other longitudinal side of the bogie 302, a support configuration with a behavior similar to a three point support may be achieved.

Since, compared to the purely mechanical design of the embodiments of FIG. 1 to 4, the hydraulic compensation device 307 with its simple and arbitrarily arranged hydraulic line 307.4 provides for coupling and synchronization between the first interface 306.7 and the second interface 306.8. Thus, a particularly lightweight and simple design of particularly small size may be achieved.

In order to limit the equalization between the wheel contact forces of the first wheel 303.1 and the second wheel 304.1 to reasonable load situations, stop elements (not shown) may be provided, for example, within the compensation cylinders 307.1 and 307.3.

Since, here as well, the compensation device 307 forms part of the sprung mass of the bogie 302, the compensation device 307 is subjected to reduced dynamic loads and, thus, may be relatively light, simple and of small size. Thus, compared to the known goose neck bogie mentioned initially, the overall mass, in particular the non-sprung mass, of the bogie 302 is considerably reduced leading to improved dynamic behavior of the bogie 302 compared to known goose neck bogies.

The first primary spring unit 306.1 and the second primary spring unit 306.2 form a resetting device resetting the compensation lever 307.1, i.e. the compensation device 307, back to its neutral position under a corresponding load situation. The resetting device may further comprises adjustable resetting springs, for example, within the compensation cylinders 307.1 and 307.3, of similar function as the ones described in the context of FIGS. 2 and 3.

The wheel set bearing units 303.3, 303.4, 304.3 and 304.4, respectively, again are located outside the space formed between the wheels of the associated wheel set 303 and 304, respectively. This external support has the advantage that sufficient space is available between the wheels for traction and braking equipment etc.

Although the present invention in the foregoing has only been described in the context of bogie frames externally supported on the wheel sets, it will be appreciated that it may also be applied to bogie frames internally (i.e. between the wheels of the wheel set) supported on the wheel sets.

Furthermore, the present invention in the foregoing has only been described in the context of bogies with wheel sets. However, it will be appreciated that the invention may also be applied to bogies with any other wheels arrangements, e.g. bogies with individual wheels etc.

The invention claimed is:

1. A bogie for a rail vehicle having a longitudinal bogie axis and comprising:

a first wheel unit comprising two wheels;

a second wheel unit comprising two wheels; and a bogie frame;

wherein said first wheel unit is spaced from said second wheel unit along said longitudinal bogie axis, said bogie frame is supported on said first wheel unit and said second wheel unit via a primary spring unit per wheel, a first primary spring unit is associated with a first wheel of said first wheel unit and a second primary spring unit is associated with a second wheel of said second wheel unit, said first wheel and said second wheel being located on the same side of said bogie frame, and said first wheel unit and said second wheel unit are connected via a compensation device mounted to said bogie frame, further wherein said compensation device is connected to said first wheel unit via a first interface of said first primary spring unit and to said second wheel unit via a second interface of said second primary spring unit, and said compensation device is arranged such that a shift of said first interface causes a shift of said second interface and wherein said compensation device has a neutral state and at least one damping device is provided to damp deflection of said compensation device from said neutral state.

2. The bogie according to claim 1, wherein said compensation device is movably mounted to said bogie frame.

3. The bogie according to claim 1, wherein said compensation device comprises a compensation lever, tiltably mounted to said bogie frame.

4. The bogie according to claim 1, wherein said compensation device comprises a compensation rod, shiftably mounted to said bogie frame.

5. The bogie according to claim 4, wherein said first primary spring unit has a first longitudinal spring unit axis, said second primary spring unit has a second longitudinal spring unit axis and said compensation rod has a third longitudinal axis;

said first longitudinal spring unit axis, said second longitudinal spring unit axis and said third longitudinal axis are substantially parallel.

6. The bogie according to claim 1, wherein a wheel bearing unit is provided for each of said wheels, said wheel bearing unit is tiltably mounted to said bogie frame and is further connected to said bogie frame by one of said primary spring units.

7. The bogie according to claim 6, wherein said wheel bearing unit is formed in the manner of an angular lever having a first end, a second end and an articulation point located between said first end and said second end;

said wheel bearing unit being tiltably mounted to said bogie frame at said articulation point;

said wheel bearing unit contacting one of said wheel units at said first end; and said wheel bearing unit contacting one of said primary spring units at said second end.

8. The bogie according to claim 1, wherein each one of said primary spring units has a longitudinal spring unit axis that is substantially parallel to said longitudinal bogie axis.

9. The bogie according to claim 1, wherein a resetting device is provided for resetting said compensation device to said neutral state.

10. The bogie according to claim 9, wherein said resetting device is one of a component of said compensation device and formed by at least one of said first primary spring unit and said second primary spring unit.

11. The bogie according to claim 1, wherein said compensation device comprises at least one movable part, said movable part is movable with respect to said bogie frame and said movable part is guided during operation of said compensation device by at least one of said first primary spring unit and said second primary spring unit.

12. The bogie according to claim 1, wherein a deflection resistance device is provided that defines a deflection resistance profile of a resistance of said compensation device against deflection from said neutral state.

13. The bogie according to claim 12, wherein said deflection resistance profile is one of a linear profile and a progressively mounting profile.

14. The bogie according to claim 12, wherein said deflection resistance profile is adjustable.

15. The bogie according to claim 1, wherein at least one stop device is provided to limit deflection of said compensation device from said neutral state.

16. The bogie according to claim 1, wherein a wheel bearing unit is provided for each of said wheels, and said wheel bearing unit is arranged externally to a space formed between said wheels of one of said wheel units.

17. The bogie according to claim 1, wherein said compensation device comprises at least one coupling device coupling said first interface and said second interface using a working fluid.

18. A rail vehicle comprising a bogie according to claim 1.

* * * * *